US008336745B2

(12) United States Patent
Brannon et al.

(10) Patent No.: US 8,336,745 B2
(45) Date of Patent: Dec. 25, 2012

(54) DISPENSING CLOSURE HAVING A FLOW CONDUIT WITH KEY-HOLE SHAPE

(75) Inventors: Patrick J. Brannon, Warwick, RI (US); Clifford W. Skillin, Blackstone, MA (US); Sergey Romanov, Cranston, RI (US)

(73) Assignee: MWV Slatersville, LLC, Slatersville, RI (US)

( * ) Notice: Subject to any disclaimer, the term of this patent is extended or adjusted under 35 U.S.C. 154(b) by 0 days.

(21) Appl. No.: 13/114,777

(22) Filed: May 24, 2011

(65) Prior Publication Data

US 2011/0284590 A1 Nov. 24, 2011

Related U.S. Application Data

(63) Continuation-in-part of application No. 12/616,346, filed on Nov. 11, 2009, now Pat. No. 7,980,432, which is a continuation-in-part of application No. 11/849,979, filed on Sep. 4, 2007, now Pat. No. 7,735,699.

(60) Provisional application No. 61/347,708, filed on May 24, 2010, provisional application No. 60/893,883, filed on Mar. 8, 2007, provisional application No. 60/824,322, filed on Sep. 1, 2006.

(51) Int. Cl.
*B65D 47/00* (2006.01)
*B65D 39/00* (2006.01)
*B65D 43/18* (2006.01)

(52) U.S. Cl. ..... 222/547; 222/564; 222/575; 222/556; 215/235; 220/259.1; 220/375; 220/837

(58) Field of Classification Search ..... 222/547, 222/556, 571, 557, 562, 546, 564, 563, 575, 222/477, 519, 520, 521, 454, 456; 215/235, 215/330, 256, 254, 306; 220/254.1, 254.2, 220/254.3, 254.4, 258.1, 259.1, 259.2, 291, 220/837

See application file for complete search history.

(56) References Cited

U.S. PATENT DOCUMENTS 330,545 A 11/1885 Barker (Continued)

FOREIGN PATENT DOCUMENTS

DE 4214548 11/1993

(Continued)

OTHER PUBLICATIONS

PCT Notification of Transmittal of International Search Report and the Written Opinion of the International Searching Authority, for the Declaration for International Application No. PCT/US07/77520.

(Continued)

*Primary Examiner* — Kevin P Shaver
*Assistant Examiner* — Stephanie E Williams
(74) *Attorney, Agent, or Firm* — Barlow, Josephs & Holmes, Ltd.

(57) ABSTRACT

A dispensing closure has a key-hole shaped flow conduit that provides a sufficient flow restriction to prevent unwanted spurting of the product. The dispensing closure includes a closure body with an upper and lower deck, inner and outer skirt, and a flow conduit extending through the upper deck. The flow conduit includes including two or more vertically oriented walls and a bottom wall. The vertically oriented walls define a fluid trapping area and a partition wall depending downwardly from said upper deck. The bottom wall configured and arranged to be positioned along a horizontal axis. The flow conduit includes one entrance orifice having one entrance axis and an exit orifice having an exit axis. The entrance axis is stepped or offset from the exit axis whereby the flow conduit provides a non-linear flow path of product from an interior of the closure to an exterior of the closure.

4 Claims, 13 Drawing Sheets

U.S. PATENT DOCUMENTS

| | | | | | |
|---|---|---|---|---|---|
| 1,844,442 | A | | 2/1932 | Schmalz | |
| 2,130,749 | A | | 9/1938 | Von Till | |
| 2,313,031 | A | | 3/1943 | Parkhurst | |
| 2,921,724 | A | | 1/1960 | Whitney | |
| 3,055,526 | A | | 9/1962 | Plunkett | |
| 3,289,885 | A | | 12/1966 | Villaveces | |
| 3,297,211 | A | * | 1/1967 | Unger | 222/479 |
| 3,311,275 | A | * | 3/1967 | Gibson | 222/567 |
| 3,353,725 | A | | 11/1967 | Caceres | |
| 3,361,307 | A | * | 1/1968 | Clare | 222/489 |
| 3,439,843 | A | | 4/1969 | Corsette | |
| 3,563,422 | A | * | 2/1971 | Cruikshank | 222/478 |
| 3,618,170 | A | | 11/1971 | Owens | |
| 3,690,496 | A | | 9/1972 | Gibson | |
| 3,693,847 | A | | 9/1972 | Gibson | |
| 3,734,332 | A | | 5/1973 | Grulich | |
| 3,784,045 | A | | 1/1974 | Komendowski | |
| 3,827,593 | A | | 8/1974 | Kramb et al. | |
| 3,877,598 | A | | 4/1975 | Hazard | |
| 3,980,211 | A | | 9/1976 | Owens | |
| 4,209,485 | A | | 6/1980 | Greenspan | |
| 4,241,855 | A | | 12/1980 | Yoshioka | |
| 4,264,022 | A | | 4/1981 | Perne et al. | |
| 4,343,754 | A | | 8/1982 | Wilde et al. | |
| 4,487,342 | A | | 12/1984 | Shy | |
| 4,564,113 | A | | 1/1986 | Mendler | |
| 4,579,241 | A | | 4/1986 | Hayes | |
| 4,649,013 | A | | 3/1987 | Yamamoto et al. | |
| 4,749,108 | A | | 6/1988 | Dornsbusch et al. | |
| 4,767,587 | A | | 8/1988 | Towns et al. | |
| 4,778,071 | A | | 10/1988 | Fillmore | |
| 4,782,985 | A | | 11/1988 | Kinsley | |
| 4,880,140 | A | | 11/1989 | Solomon et al. | |
| 4,949,880 | A | | 8/1990 | Bradley | |
| 5,033,655 | A | | 7/1991 | Brown | |
| 5,042,775 | A | | 8/1991 | Willemsen | |
| 5,048,723 | A | | 9/1991 | Seymour | |
| 5,123,575 | A | | 6/1992 | Li | |
| 5,125,541 | A | | 6/1992 | Anglehart | |
| 5,197,634 | A | | 3/1993 | Beck | |
| 5,271,531 | A | | 12/1993 | Rohr et al. | |
| 5,277,318 | A | | 1/1994 | Smalley, Jr. et al. | |
| 5,285,913 | A | | 2/1994 | Morton | |
| 5,292,020 | A | | 3/1994 | Narin | |
| 5,332,131 | A | | 7/1994 | Pehr | |
| 5,370,284 | A | | 12/1994 | Dirksing | |
| 5,472,122 | A | | 12/1995 | Appleby | |
| 5,509,582 | A | | 4/1996 | Robbins, III | |
| 5,512,228 | A | | 4/1996 | Adams et al. | |
| 5,518,152 | A | | 5/1996 | Burcham et al. | |
| 5,547,091 | A | | 8/1996 | Neveras et al. | |
| 5,779,110 | A | | 7/1998 | Brown et al. | |
| 5,819,994 | A | | 10/1998 | Leipold | |
| 5,820,807 | A | | 10/1998 | Urmston | |
| 5,875,909 | A | | 3/1999 | Guglielmini | |
| 5,992,659 | A | | 11/1999 | Nofer et al. | |
| 6,006,960 | A | | 12/1999 | Gross | |
| 6,029,861 | A | | 2/2000 | Gier | |
| 6,409,054 | B1 | | 6/2002 | Garibaldi | |
| 6,412,664 | B1 | | 7/2002 | Wolff et al. | |
| 6,454,130 | B1 | | 9/2002 | Miller et al. | |
| 6,523,720 | B1 | | 2/2003 | Robbins, III | |
| 6,564,978 | B1 | | 5/2003 | Safian et al. | |
| 6,609,694 | B2 | | 8/2003 | Francois et al. | |
| 6,644,620 | B2 | | 11/2003 | Johnson | |
| 6,685,041 | B1 | | 2/2004 | Geisinger | |
| 6,837,402 | B2 | | 1/2005 | Cardia | |
| 6,880,736 | B1 | | 4/2005 | Gnepper | |
| 7,014,075 | B2 | | 3/2006 | Bonifacio et al. | |
| 7,735,699 | B2 | | 6/2010 | Brannon et al. | |
| 7,980,432 | B2 | | 7/2011 | Brannon et al. | |
| 2004/0079766 | A1 | | 4/2004 | Kokubo | |
| 2004/0245290 | A1 | | 12/2004 | Hagihara | |
| 2005/0072788 | A1 | | 4/2005 | Lieberman et al. | |
| 2005/0167455 | A1 | | 8/2005 | Yim | |
| 2006/0011667 | A1 | | 1/2006 | Skillin et al. | |
| 2006/0175357 | A1 | | 8/2006 | Hammond | |
| 2007/0102390 | A1 | | 5/2007 | Hoepner et al. | |
| 2007/0102392 | A1 | | 5/2007 | Hoepner et al. | |
| 2008/0054027 | A1 | | 3/2008 | Skillin et al. | |

FOREIGN PATENT DOCUMENTS

| | | | |
|---|---|---|---|
| EP | 1114778 | A1 | 7/2001 |
| JP | 2004001836 | | 1/2004 |
| WO | 9303338 | A1 | 2/1993 |
| WO | 9513220 | | 5/1995 |
| WO | 02074650 | A1 | 9/2002 |

OTHER PUBLICATIONS

PCT International Search Report for International Application No. PCT/US07/77520.
PCT Written Opinion for International Application No. PCT?US07/77520.
International PCT Application No. PCT/US07/77551 Transmittal.
International PCT Application No. PCT/US07/77551 Search Report.
International PCT Application No. PCT/US07/77551 Written Opinion.
International PCT Application No. PCT/US07/77562 Transmittal.
International PCT Application No. PCT/US07/77562 International Search REport.
International PCT Application No. PCT/US07/77562 Written Opinion.

* cited by examiner

DISPENSING CLOSURE HAVING A FLOW CONDUIT WITH KEY-HOLE SHAPE

CROSS REFERENCE TO RELATED APPLICATIONS

This continuation-in-part application is related to and claims priority from earlier filed, U.S. Provisional Pat. Appl. No. 61/347,708 filed May 24, 2010, U.S. Non-Provisional patent application Ser. No. 12/616,346 filed Nov. 11, 2009, U.S. Non-Provisional patent application Ser. No. 11,849,979 filed Sep. 4, 2007, U.S. Provisional Patent Application No. 60/893,883 filed Mar. 8, 2007 and U.S. Provisional Patent Application No. 60/824,322 filed Sep. 1, 2006, all of which are incorporated herein by reference.

BACKGROUND OF THE INVENTION

The present invention relates to container closures, and more particularly to squeeze-type container dispensing closures.

There are two major trends occurring in the design of dispensing containers and closures. The first trend is a focus on providing a "clean pour" during dispensing of the product. Many food products, such as mustard and ketchup, have a high viscosity and require the user to tip the container, shake down the product and then squeeze the container to dispense the product. Past dispensing closures tended to leak product onto the top deck of the closure after dispensing, creating a messy appearance and often requiring cleaning to reseal the closure. The current emphasis in "clean pour" design is on preventing spurting of the product when the container is inverted to the dispensing position and/or shaken down, and creating a "suck-back" effect as pressure is released from the container to draw the product back into the closure.

A second trend is a growing number of dispensing containers and closures being designed so that they can be stored in an inverted position, i.e. cap down. In this regard, the product is always located right at the dispensing closure for easy dispensing right from storage. This reduces the need to tip and shake the container to push the product down to the dispensing closure. There is a balance however, between having the product at the closure for dispensing and the need to prevent the product from immediately spurting out once the lid of the closure is opened.

Both of these trends have resulted in the design of dispensing closures having various types of valve structures that facilitate both a clean pour and inverted storage. For example, a silicone valve structure is illustrated and described in U.S. Pat. No. 5,271,531. While these silicone valves have been widely accepted by both the manufacturers and the consumers, they are somewhat more difficult to manufacture, as they require several inter-fitting parts, and thus they tend to be more expensive than traditional one-piece dispensing closures.

Another perceived drawback to the silicone valve closure is that they are constructed out of two different types of plastic and thus, from a recycling standpoint, they are more difficult to recycle because the silicone valve must be separated from the plastic closure body for recycling. While this is not a major issue in the United States, at least yet, it is currently a major issue in Europe where recycling is extremely important and even mandated in some countries.

Other designs of dispensing closures focus on the use of interior partitions to slow the flow of the product exiting the dispensing orifice. For example, U.S. Pat. No. 5,123,575 discloses a design of a dispensing closure having multiple chambers. This patent discloses a container for motor oil with three interior chambers, namely a primary chamber between the first partition and the bottom wall, a secondary partition between the first and second partitions and a tertiary chamber between the top wall and the second partition. While the concept of the design may provide the desired flow characteristics, the design is virtually impossible to mold using conventional injection molding or blow molding techniques and thus is not commercially feasible.

U.S. Pat. No. 5,819,994 also discloses a dispensing closure using multiple chambers. This patent discloses a flow controlling cap for a fluid (water) container that controls fluid flow by means of gravity and pressure, and has a first chamber formed by a first hollow cylinder and a second chamber formed by a second hollow cylinder having a greater diameter than the first hollow cylinder. While the circuitous path of this design is effective for water, the flow characteristics of water are different than other viscous fluids and thus the design is not believed to be suited for other more viscous products. In short, it would be difficult to force viscous fluids through the multi-chamber design.

Accordingly, there exists a need in the industry for a one-piece dispensing closure that provides a "clean pour" and prevents premature flowing of viscous product prior to squeezing the dispensing container. In addition, there exists a need a design of a dispensing closure that is easy to mold and made of one type of recyclable plastic.

DESCRIPTION OF THE INVENTION

Brief Description of the Drawings

The novel features which are characteristic of the dispensing closure are set forth in the appended claims. However, the dispensing closure, together with further embodiments and attendant advantages, will be best understood by reference to the following detailed description taken in connection with the accompanying drawing Figures.

DETAILED DESCRIPTION OF THE PREFERRED EMBODIMENTS

Figure 1:
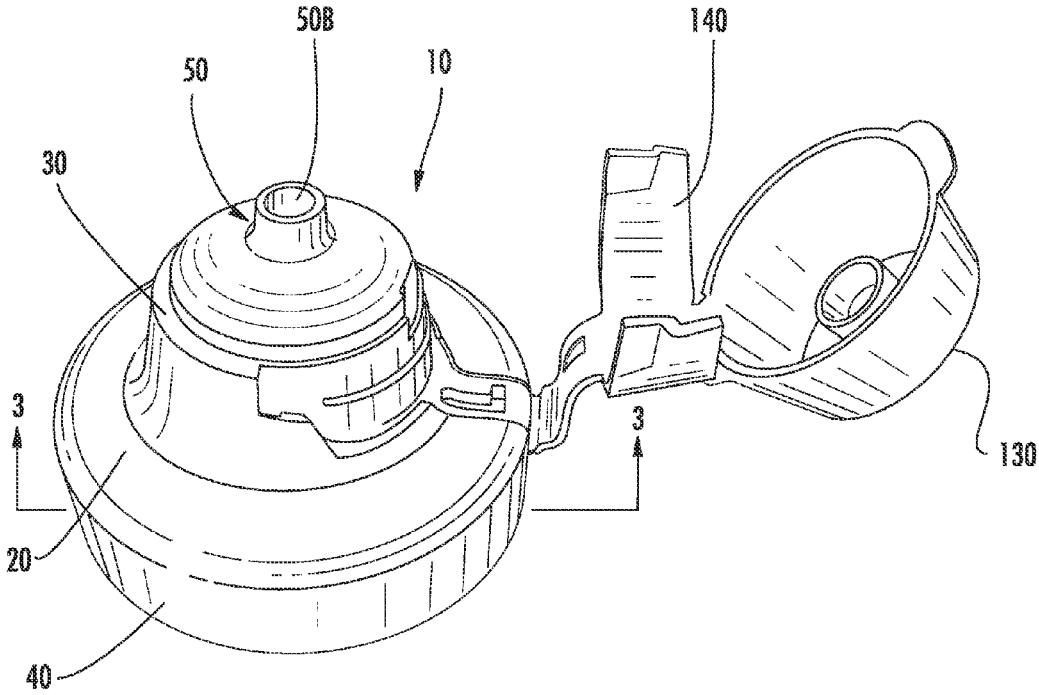
FIG. 1 is a perspective view of the dispensing closure constructed in accordance with the teachings of the present invention.

Referring now to the drawings, the dispensing closure 10 of the instant invention is illustrated in FIGS. 1-4. As will hereinafter be more fully described, the instant dispensing closure 10 includes a unique flow conduit arrangement, which includes an offset, obstructed, and non-linear flow path. The unique arrangement provides anti-spurting in upright containers as well as "suck-back" for cleaner product dispensing, i.e. "clean pour".

Generally, the dispensing closure 10 comprises a closure body 20, a closure lid 130 and a living hinge structure 140 hingeably connecting the closure lid 130 to the closure body 20. The closure body 20 has an upper deck 30 and a skirt 40 depending from the upper deck 30 where the skirt 40 is configured and arranged to mount to a product container (not shown). Preferably, the product container is a conventional squeeze-type container. Preferably, the skirt 40 is internally threaded for threaded mounting on a product container (See FIG. 2). However, it is to be understood that other skirt mounting arrangements are also contemplated within the scope of the invention, and the invention should not be limited to the inwardly threaded skirt as the only means for mounting.

Figure 2:
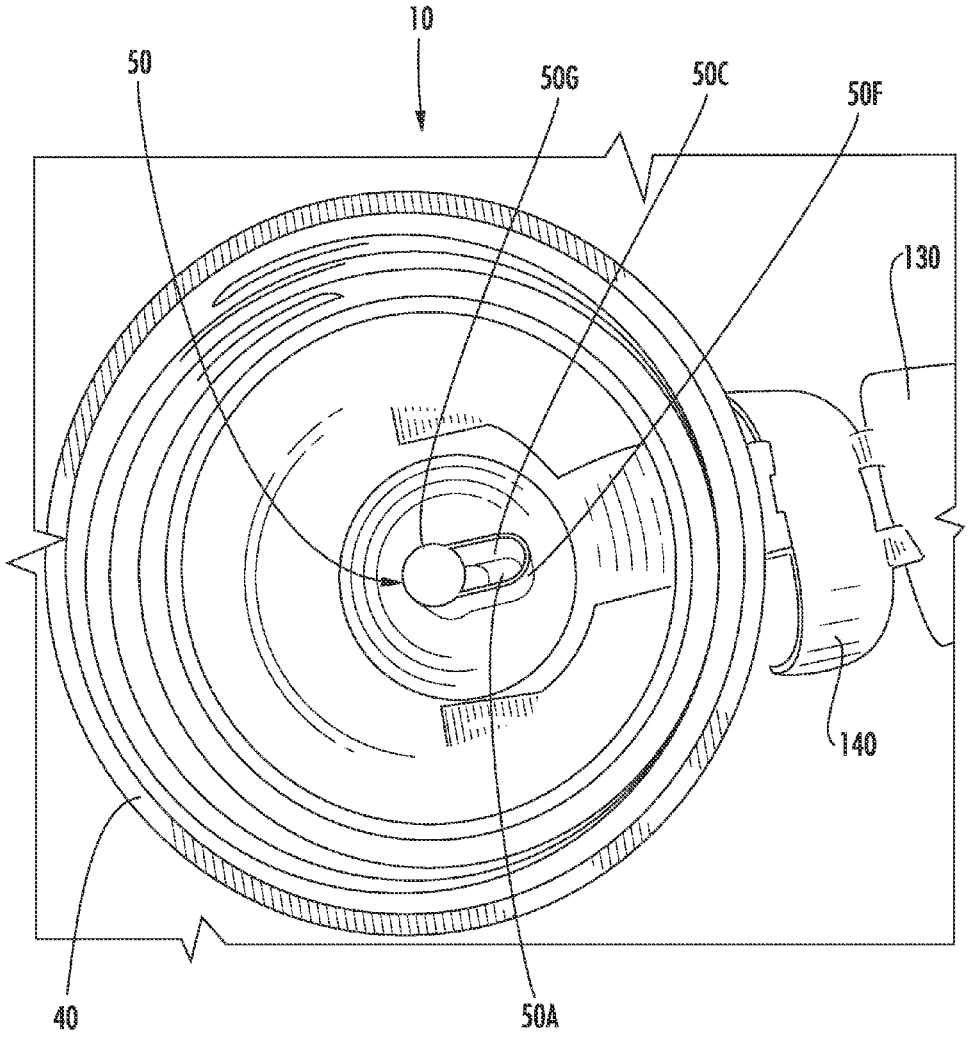
FIG. 2 is a bottom view thereof.
Figure 3:
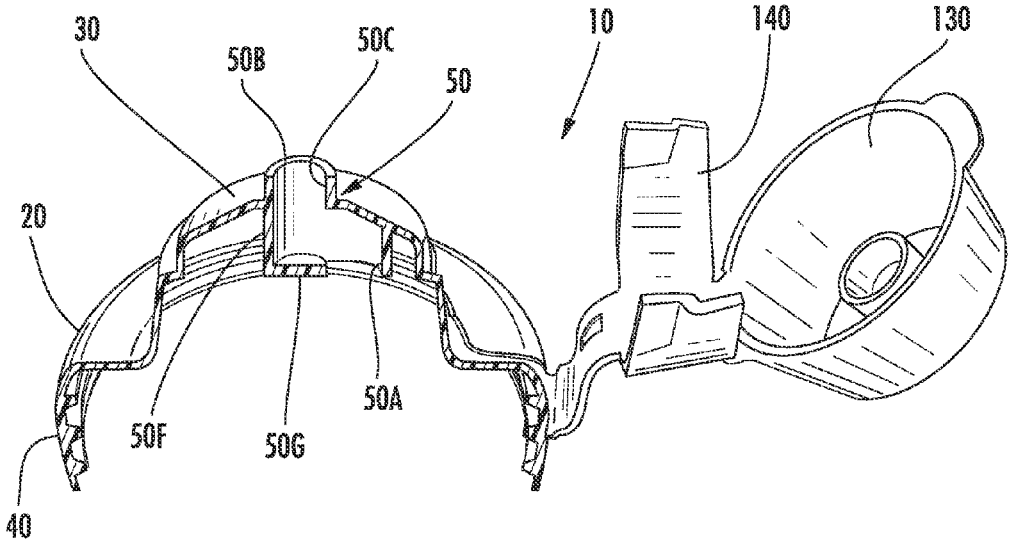
FIG. 3 is a cross-sectional view of thereof as taken along line 3-3 of FIG. 1.
Figure 4:
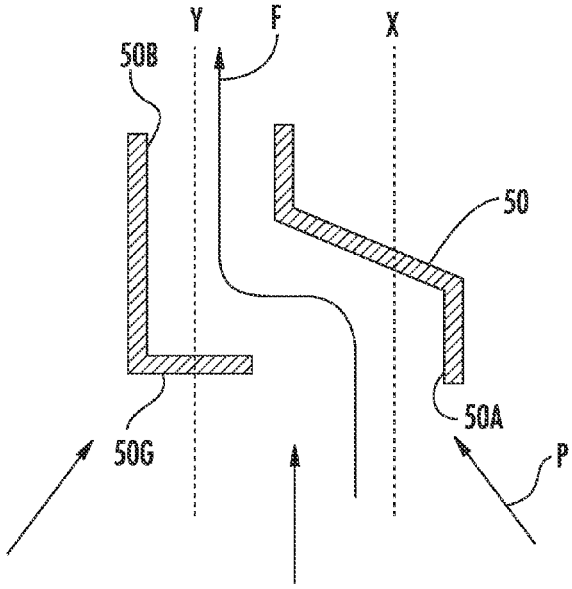
FIG. 4 is a diagrammatical view thereof.

A flow conduit generally indicated at 50 extends through the upper deck 30 for the passage of a viscous product, such as mustard. The flow conduit 50 is generally defined by an interior wall 50C, an exterior wall 50F, and a bottom wall 50G (baffle). The flow conduit 50 includes an entrance orifice 50A (inside the container) having an entrance axis X and an exit orifice 50B (outside the container) having an exit axis Y. Generally, the entrance axis X is offset from the exit axis Y to provide a non-linear flow path (see arrows F) from the interior of the closure 10 to the exterior of the closure. More specifically, the flow conduit 50 is expanded to the side of the exit orifice 50B, and the entrance orifice 50A is located in the bottom wall 50G, but offset from the exit orifice 50B. The entrance axis X is thus parallel to but not co-linear with the exit axis Y. Referring briefly to FIG. 2, it is noted that the overall shape of the flow conduit 50 when viewed from the bottom is a key-hole shape.

The bottom wall 50G of the conduit thus prevents the direct flow of product (see arrows P—FIG. 1A) into the flow conduit along the exit axis Y and acts as a baffle to counter product head pressure created by either storing the product in an inverted condition, or head pressure created when an upright container is quickly inverted to dispense product. Flow of the product is shown by arrow F.

The baffling effect is also enhanced by the passage of the product from the container, through the small entrance orifice 50A and into the interior of the flow conduit 50. The velocity of the product will increase as it travels through the entrance orifice 50A. However, the velocity of the product then decreases as it travels into the larger interior volume of the flow conduit 50 before it leaves through the exit orifice 50B. Spurting thus occurs into the interior of the flow conduit 50 and not directly out of the exit orifice. Accordingly, when the container is inverted, and is rapidly shaken up and down by a user to dispense the product, the product first decelerates into the larger volume interior flow conduit 50, and does not spurt out the exit orifice 50B. When pressure is applied to the squeeze container, the product is then forced out of the exit orifice 50B.

It is to be noted that the dimensions of the flow conduit 50 are adjustable, depending upon the viscosity of the product stored within an interior of the dispensing closure 10. For example, if lower viscosity mustard is contained within the interior of the dispensing closure 10, it may be desirable for the flow conduit 50 to be smaller in size or dimension to achieve a lower flow rate. In the preferred embodiment as shown, the exit orifice 50B is circular, and is somewhat smaller than the entrance orifice 50A.

Referring to FIGS. 5-11, a dispensing closure 10A-E, in another embodiment, incorporates the advantages and benefits of the above-mentioned dispensing 10 closure and further includes include a dispensing closure 10A with a double-key hole shape of the flow conduit 200 (FIGS. 5-7) and a dispensing closure 10B-E, with a key-hole flap as a bottom wall 305B-E of the flow conduit 300B-E (FIGS. 8-11), which are further explained herein. The dispensing closures 10A-E are one-piece elements formed of plastic material or other compatible materials for delivery of highly viscous fluids. The closures 10A-E include a closure body 20A-E or closure base, a closure lid 140A-E, and a dual living hinge structure 140A-E hingeably connecting said closure lid 130A-E to said closure body 20A-E. A dual living hinge structure 140A-E is an example of one type of hinge structure used and it is contemplated that other types of hinge structures may be used.

The closure body 20A-E includes an inner 60A-E and outer skirt 40A-E defining a longitudinal center axis or exit axis Y of the closure body 20A-E. The inner skirt 60A-E located at an upper portion of the closure body 20A-E and an outer skirt 40A-E located at a lower portion of the closure body 20A-E. The outer skirt 40A-E has a diameter greater than the diameter of the inner skirt 60A-E. The inner skirt 60A-E is stepped inwardly of the outer skirt 40A-E and includes an inner surface facing radially inwardly towards the exit axis Y. A top portion of the inner skirt 60A-E depends from an upper deck 30A-E and is integrally formed with the upper deck 30A-E. The outer skirt 40A-E depends below a lower deck 70A-E and is integrally formed with the lower deck 70A-E.

The upper deck 30A-E extends transversely from a top portion of the inner skirt 60A-E towards the exit axis Y to define an exit orifice 51A-E. In one embodiment, the upper deck 30A-E and the lower deck 70A-E have a substantially planar surface. The exit orifice 51A-E is concentric to the surface of the upper deck 30A-E. It is also contemplated that the exit orifice 51A-E is eccentric to the surface of the upper deck 30A-E. The exit orifice 51A-E defines, in one embodiment, a circular or cylindrical opening in a top end of the closure body 20A-E for highly viscous fluid to exit therethrough. The exit orifice 51A-E has an exit axis Y collinear with the center axis of the closure body 20A-E.

The exit orifice 51A-E includes a spout 80A-E which extends above a horizontal plane of the upper deck 30A-E. The spout 80A-E defines a cylindrical wall extending vertically above an outer periphery of the exit orifice 51A-E. In an alternative embodiment, the spout 80A-E is tapered or may have a non-uniform width along its length. In addition, a top end of the spout 80A-E may define a beveled edge. In one embodiment, the spout 80A-E is integrally formed with the exit orifice 51A-51B and the flow conduit 200, 300B-E.

The lower deck 70A-E is stepped downwardly from the upper deck 30A-E and extends transversely from a middle portion of the inner skirt 60A-E to a top portion of the outer skirt 40A-E. A lower portion of the inner skirt 60A-E depends from the upper deck 30A-E into an interior of the dispensing closure 10A-E. The inner skirt 60A-E extends along a substantially vertical axis parallel to the exit axis Y and terminates above a bottom end of the closure 10A-E.

The top portion of the outer skirt 40A-E defines a ledge 90A-E for engaging an outer periphery of the closure lid 130A-E. The ledge 90A-E is stepped downward from the lower deck 70A-E and transversely extends from an outer surface of the outer skirt 40A-E. The ledge 90A-E defines a width sufficient for seating or mating an outer peripheral wall of the closure lid 130A-E. The ledge 90A-E and outer peripheral wall of the lid 130A-E can be adjusted to fittingly engage with one another or snap together. For example, the diameter of the closure lid 130A-E relative to the diameter of the closure body 20A-E may be adjusted to provide a friction fit between the closure lid 130A-E and the closure body 20A-E.

The outer skirt 40A-E is configured and arranged to mount to a product container (not shown). The outer skirt 40A-E includes a internal securing structure 42A-E for securing the closure 10A-E to a product container (not shown), which in the preferred embodiment is constructed as at least one helical thread or bead that is defined on the inner surface of the lower portion of the outer skirt 40A-E. The at least one helical thread is configured to mate with the securing structure, at least one helical thread, of the neck of the product container (not shown). Alternatively, the securing structure 42A-E could be embodied as an interference fit, a bayonet or snap connection, or one of many other mechanically equivalent techniques that are known in the art.

Figure 5:
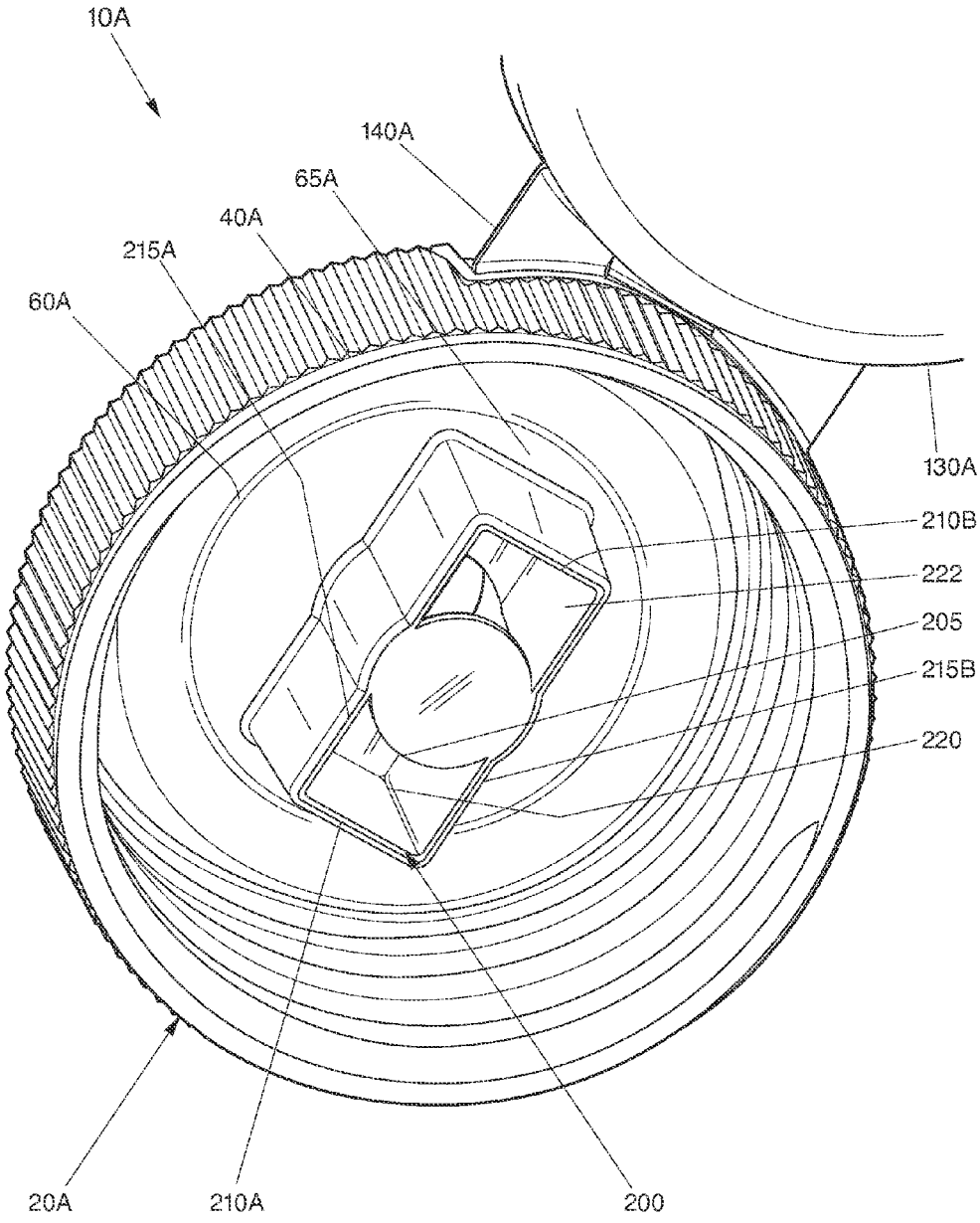
FIG. 5 is a bottom view of another embodiment having a double key-hole shaped flow conduit.

The outer surface of the outer skirt 40A-E may define a gripping surface. Referring to FIG. 5, the gripping surface includes a series of vertically spaced ribs 100A covering the outer surface of the outer skirt 40A. Of course, a gripping surface may include knurling or other types of surfaces for facilitating the grip of a user. Alternatively, the outer surface of the outer skirt 40A-E may be smooth or non-ribbed. In addition, the outer surface of the outer skirt 40A-E and the closure lid 130A-E may be provided with a finger indent.

Figure 6:
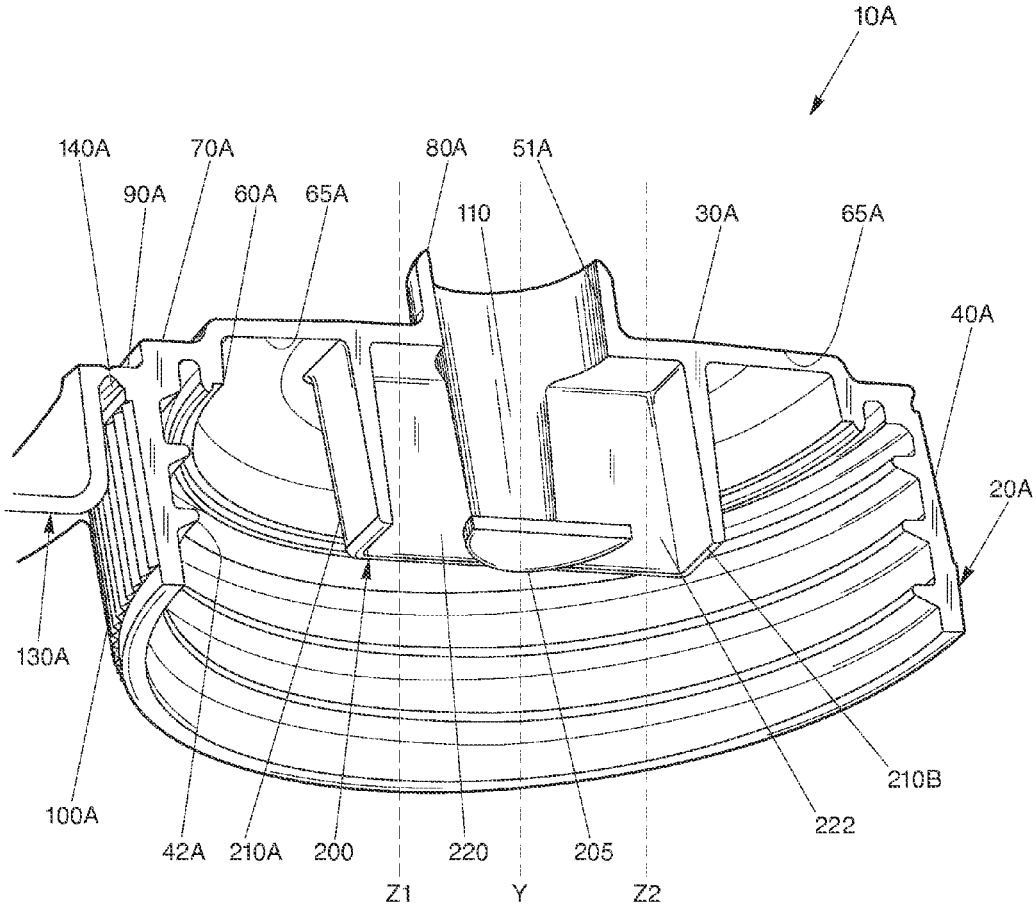
FIG. 6 is a cross-sectional view of FIG. 5.
Figure 7:
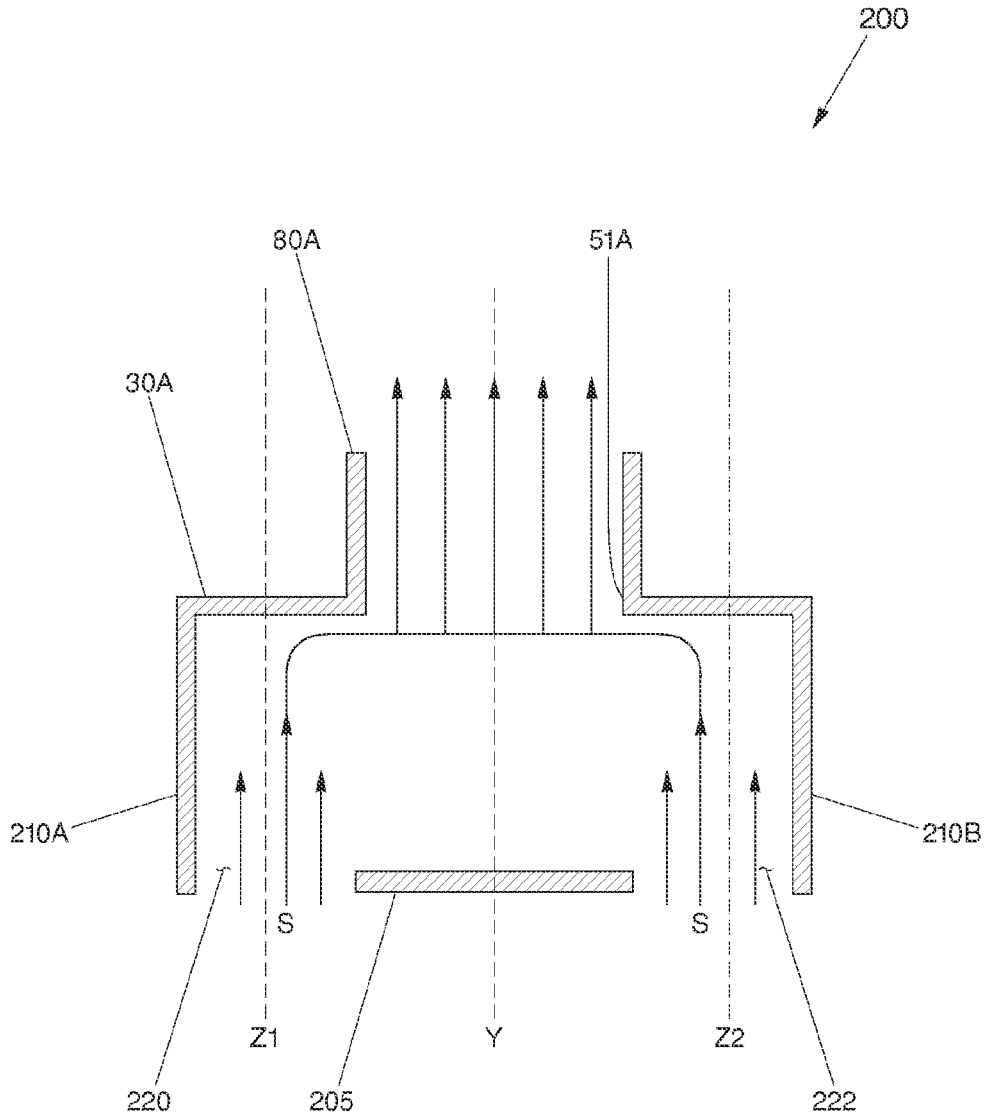
FIG. 7 is a diagrammatical view of invention of FIG. 5.

Referring to FIGS. 5-7, the flow conduit 200 of the dispensing closure 10A includes a cylindrical structure 110 extending above, below and through the upper deck 30A and exit orifice 51A. At a top end, the cylindrical structure 110 is in fluid communication with the exit orifice 51A and the spout 80A. The cylindrical structure 110 may be integrally formed with the exit orifice 51A and the spout 80A. At a bottom end, the cylindrical structure 110 extends below the upper deck 30A and terminates at a horizontal bottom wall 205. A middle portion of the cylindrical structure 110, located between the top end and the bottom end, is integrally formed with front 215A and back wall 215B of the flow conduit 200.

Referring to FIGS. 8-11, in one embodiment, the flow conduit 300B-E includes a partition wall 120B-E depending vertically below the exit orifice 51B-E. The partition wall 120B-E has an inner surface opposing the sidewall 310B-E. The partition wall 120B-E maybe adjusted according to the size, shape, dimension, and desired flow rate through the flow conduit 300. The partition wall 120B-E depends below the upper deck 30B-E, exit orifice 51B-E, and above the bottom wall 305B-E. The partition wall 120B-E and the bottom wall 305B-E define a baffling orifice 150B-E. The partition wall 120B-E provides a baffling effect to the product as it enters through the baffling orifice 150B-E and decelerates into the larger volume between the partition wall 120B-E, sidewall 310B-E, and bottom wall 305B-E.

Figure 8:
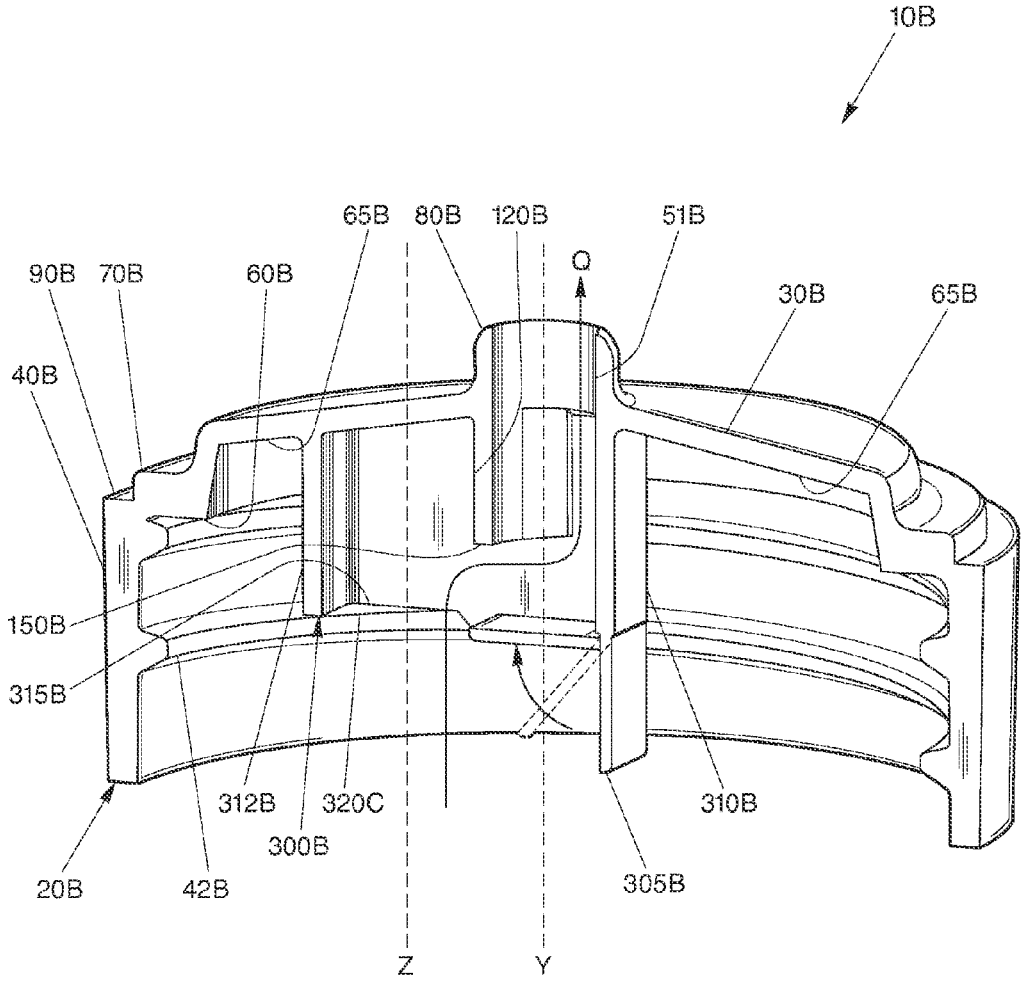
FIG. 8 is a cross-sectional view of another embodiment having a key-hole flap and a partition wall.
Figure 9:
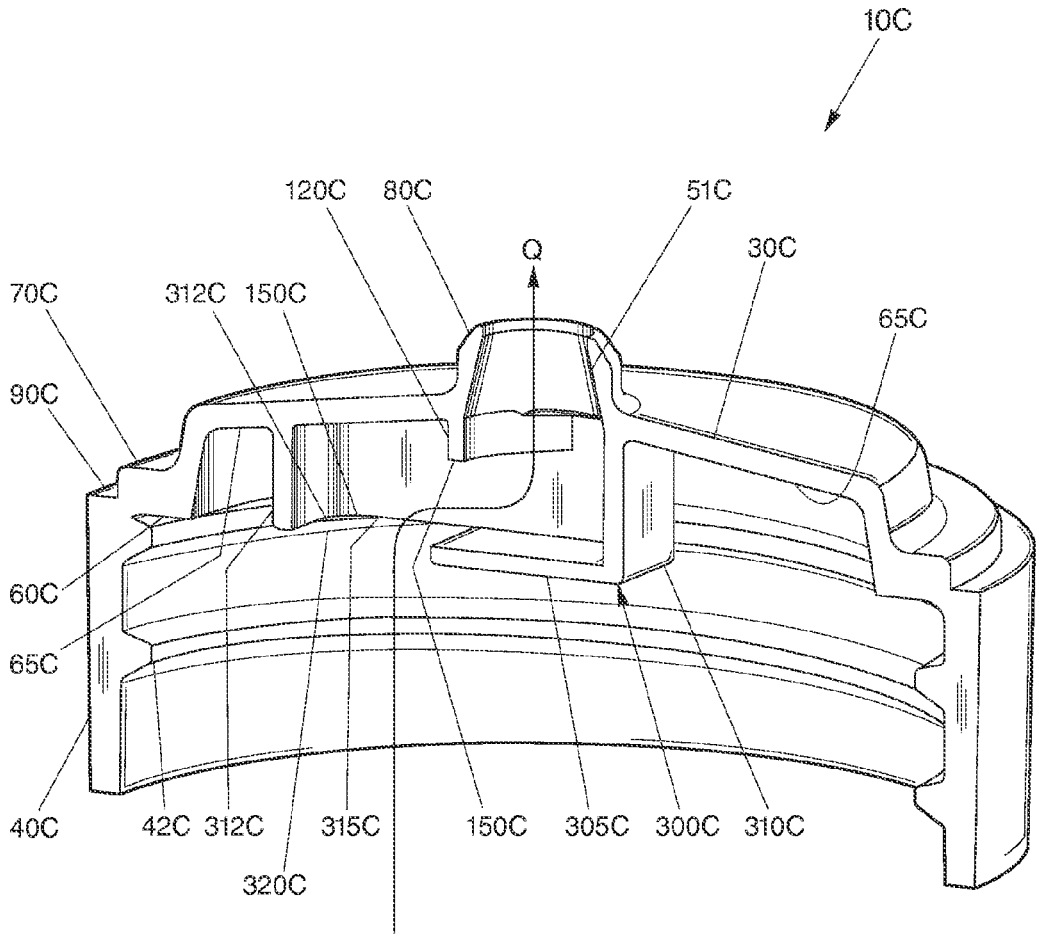
FIG. 9 is a cross-sectional view of another embodiment having a key-hole flap and a partition wall.

Referring to FIGS. 8-11, the partition wall 120B-E may have more than one configuration. In one embodiment, the partition wall 120B-E has a solid curved or arctuate shape. Referring to FIG. 8, the partition wall 120B depends from the upper deck 30B and periphery of the exit orifice 51B and extends inwardly towards the exit axis Y without connecting or attaching to the opposing side wall 310B. The partition wall 120B-E may extend downwardly with sufficient height and thickness to define the baffling orifice 150B-E for decelerating the product before it exits through the exit orifice 51B-E. Referring to FIG. 9, the partition wall 120C extends downwardly with a reduced height and reduced thickness to define the baffling orifice 150C.

Figure 10:
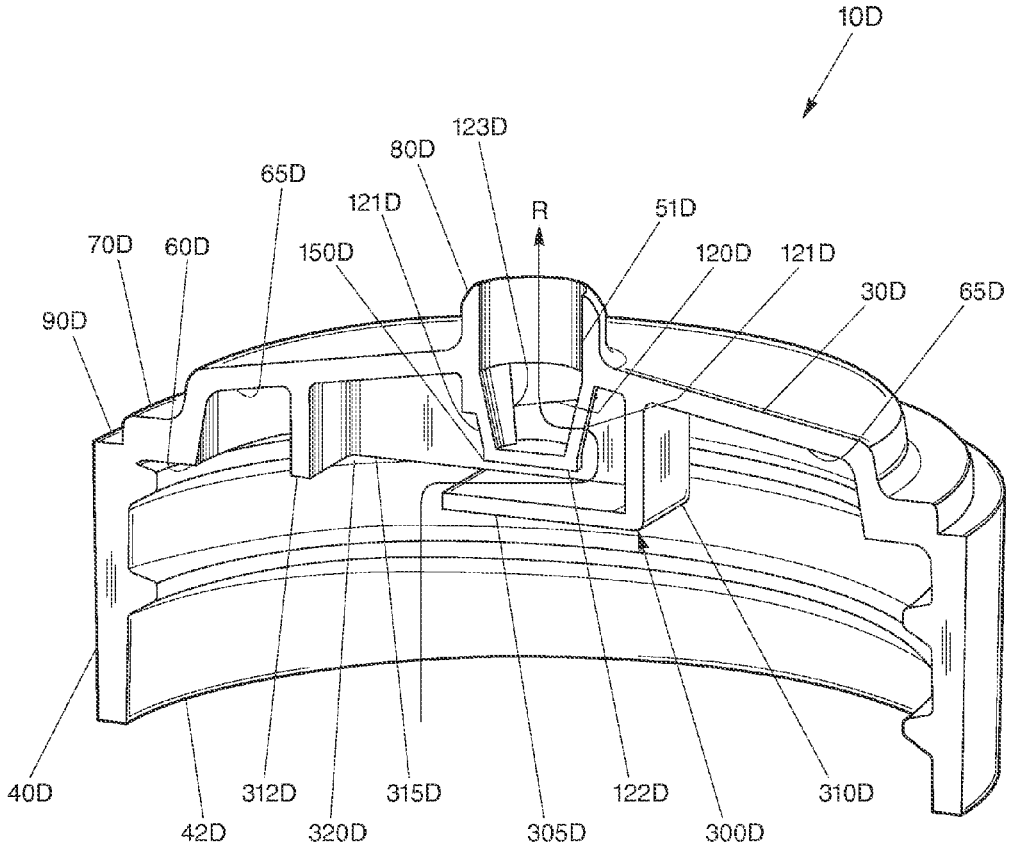
FIG. 10 is a cross-sectional view of another embodiment having a key-hole flap and a partition wall with additional baffling structure.

In another embodiment, the partition wall 120B-E can be attached or connected with additional baffling structures. Referring to FIG. 10, the vertical partition wall 120D is attached to at least one substantially vertical arm 121D positioned substantially along an exit axis. The vertical arm or arms 121D define a substantially rectangular shape. The at least one substantially vertical arm 121D is attached to a horizontal baffling wall 122D suspended beneath the exit orifice 51D and along the exit axis. The baffling wall 122D is positioned along a horizontal plane and parallel to the bottom wall 305D. The baffling wall 122D, the at least one vertical arm 121D, and the partition wall 120D define at least one or more baffling orifices 123D which allow the product therethrough. The vertical arm or arms 121D are integrally formed with the partition wall 120D and the upper deck 30D, at a top end, and baffling wall 122D at a bottom end. In one embodiment, there are three or more vertical arms 121D and baffling orifices 123D.

Referring to FIGS. 5-7, the flow conduit 200 of the dispensing closure 10A includes the bottom wall 205 which is attached, connected, or integrally formed with the front and back walls 215A, 215B and the cylindrical portion 110. The bottom wall 205 has the center axis Y passing through its center. The bottom wall 205 lies on a substantially horizontal plane or 180 degrees and is perpendicular to end portions of the front 215A, back 215B, and side walls 210A, 210B. The bottom wall 205 extends along the horizontal plane from one sidewall 210A to another sidewall 210B but terminates short of connecting or attaching with the sidewalls 210A, 210B to define one or more entrance orifices 220, 222.

The bottom wall 205 of the dispensing closure 10A is configured and arranged to be positioned along a horizontal axis perpendicular to an exit axis Y to prevent the direct flow of product into the flow conduit 200 along the exit axis Y. The bottom wall 205 defines a shape, size, and a surface area which is substantially similar to, or equivalent to the shape or surface area of the entrance orifice 51A, spout 80A, or cylindrical portion 110 of the flow conduit. In other words, the bottom wall 205 has a surface area proportionally sized to the surface area of the exit orifice 51A to prevent direct flow of product out of the exit orifice 51A. In one embodiment, the bottom wall 205 may define a circular or cylindrical shape similar to the exit orifice 51A. In another embodiment, the bottom wall may define a rectangular shape. It is also contemplated that the bottom wall has a surface area less than or equal to the surface area of the exit orifice 51A. By having a similar shape and surface area, the bottom wall 205 or baffle of the flow conduit 200 prevents the direct flow of product into the flow conduit 200 along the exit axis Y.

Referring to FIGS. 8-11, the bottom wall 305B-E of dispensing closure 10B-E, at a first end, is connected, attached, or integrally formed with the sidewall 310B-E, and front and back walls 315B-E, 317B-E of the flow conduit 300B-E. The bottom wall 305B-E defines a flap or a key-hole flap, connected or attached to the side wall 310B-E integrally formed with the upper deck 30B-E, exit orifice 51B-E, and spout 80B-E. During the manufacturing process, the bottom wall 305B-E is molded vertically or downwardly and then pivoted or folded horizontally or upwardly to prevent the direct flow of product along the exit axis Y and through the exit orifice 51B-E.

In one embodiment, the bottom wall 305B-E and the side wall 310B-E are integrally formed or molded together and are foldable relative to one another using methods known in the art. For example, the bottom wall 305B-E and the side wall 310B-E may have a perforated or folding line extending therebetween. In another example, the thickness of the material between the bottom wall 305B-E and the sidewall 305B-E may be thinned or reduced to allow the bottom wall 305B-E to fold upwardly towards the side wall 310B-E. In another embodiment, the bottom wall 305B-E may be hingedly or pivotally connected to the side wall 310B-E using a hinge or other connection structure. Of course, these are examples and other methods of folding or pivoting the bottom wall 305B-E relative to the side wall 310B-E are also contemplated.

Figure 11:
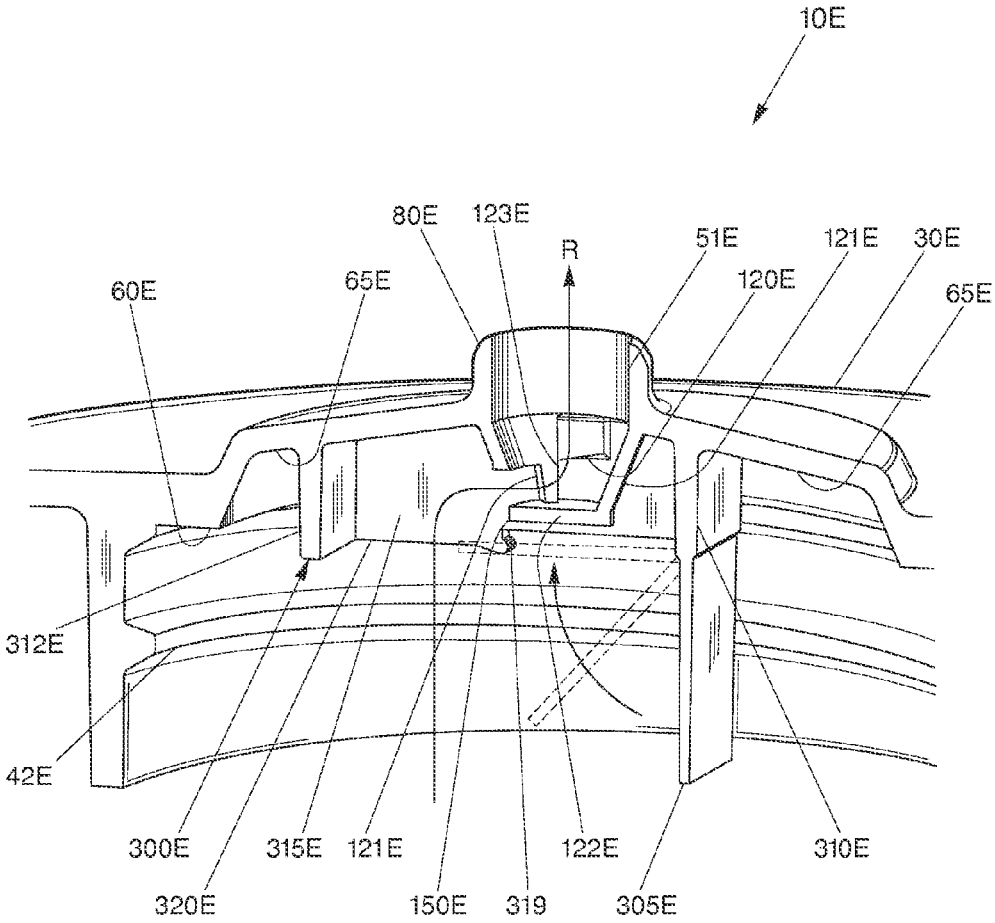
FIG. 11 is cross-sectional view of another embodiment having a key-hole flap and partition wall with an additional baffling structure.

Referring to FIG. 11, the flow conduit 300B-E may define a connection area 319E for attaching, connecting, engaging, or latching a second end of the bottom wall 305E. The second end of the bottom wall 305E is configured for securing to the connection area 319E when in a folded or horizontal position. In one embodiment, the connection area 319E defines a latching groove for attachment with the second end of the bottom wall 305E. The second end of the bottom wall 305E frictionally engages the latching groove of the connection area 319E to secure the bottom wall 305E in a closed position and prevent the direct flow of product out of the exit orifice 51E. When in a secured or closed position, the bottom wall 305E engages a bottom end of the flow conduit 300E including the side wall 310E, front wall 317E, and back walls 315E. Other alternative methods known in the art for attaching, latching, connecting, or securing the second end of the bottom wall 305E into the closed position is also contemplated.

In an open position, before folding or pivoting towards the sidewall 310E, the bottom wall 305E allows the direct flow of product out of the exit orifice 51E. In a closed position, after folding or pivoting towards the sidewall 310E, the bottom wall 305E prevents the direct flow of product into the exit orifice 5 51E along the exit axis Y. The bottom wall 305E is configured to pivot or fold from a vertical position along a similar axis to the side wall 310E to a horizontal position along an axis perpendicular to the entrance axis Z.

In one embodiment, one entrance orifice 320B-E is defined by the bottom wall 305B-E, sidewalls 310B-E, and front and backs walls 315B-E, 317B-E. The entrance orifice 320B-E is offset or stepped from the exit orifice 51B-E and exit axis Y. The entrance orifice 320B-E (inside the container) has an entrance axis Z. The entrance orifice 320B-E is generally non-circular or rectangular in shape. The flow rate of the product, once the product enters through the entrance orifice 320B-E and into the interior of the flow conduit 300B-E, decelerates.

Referring to FIGS. 5-7, two entrance orifices 220, 222 are defined by the bottom wall 205, sidewalls 210A, 210B, and front and back walls 215A, 215B. A first 220 and a second entrance orifice 222, or two entrance orifices, are offset or stepped from the exit axis Y and exit orifice 51A. The two entry or entrance orifices 220, 222 (inside the container) have two different entrance axes Z1, Z2. The entrance orifices 220, 222 are generally non-circular or rectangular in shape and, in one embodiment, are similar or identical in size, shape, and surface area relative to one another. The entrance orifices 220, 222, by having similar or identical size, shape, and surface area provide substantially similar flow rates of product into an interior of the flow conduit 200. The flow rate of the product, once the product enters through the separate entrance orifices 220, 222 and into the interior of the flow conduit 200, decelerates when the product entering the separate entrance orifices 220, 222 meets.

The first entrance orifice 220 has an entrance axis Z1 and is positioned on an interior of the dispensing closure 10A. Generally, the entrance axis Z1 is offset or stepped from the exit axis Y. The second entrance orifice 222 has an entrance axis Z2 and is positioned on an interior of the dispensing closure 10A. Generally, the entrance axis Z2 is offset or stepped from the exit axis Y. In one embodiment, the entrance axis Z1 and entrance axis Z2 are offset or stepped from one another at an equal distance from the exit axis Y. Both the first and second entrance axes Z1, Z2 are parallel to but not collinear or intersect with the exit axis Y. Both the first and second entrance axes Z1, Z2 are parallel to but not collinear or intersect with one another. The entrance axes Z1, Z2 are parallel to, but not co-linear with, the exit axis Y to provide a non-linear or indirect flow path from an interior of the closure 10A to the exterior of the closure 10A.

The flow conduit 200 of the dispensing closure 10A includes two or more vertically oriented sidewalls 210A, 210B depending downwardly from the upper deck 30A. In one embodiment, the two sidewalls 210A, 210B are positioned equally from the center axis Y and depend downwardly along a substantially vertical axis or 90 degree angle parallel to the exit axis Y. The two sidewalls 210A, 210B directly opposing each other are similar or identical in shape, size, and surface area. The distance between a first sidewall 210A to the bottom wall 205 is equivalent to the distance between the second sidewall 210B and the bottom wall 205. Also, the distance between the side walls 210A, 210B is greater than width of the exit orifice 51A. Both sidewalls 210A, 210B terminate within the interior of the dispensing closure 10A near a lower portion of the outer skirt 40A including the securing structure 42A. Both sidewalls 210A, 210B, at a top end, are integrally formed with the upper deck 30A. The sidewalls 210A, 210B are tapered along its length starting at the top end and extending to the bottom end. The bottom ends of the sidewalls 210A, 210B defining a beveled edge. The sidewalls 210A, 210B lie along a vertical plane similar to the vertically oriented skirt 20A.

Referring to FIGS. 8-11, the first sidewall 310B-E is positioned closer to the center axis or exit axis Y than the second sidewall 312B-E. Both sidewalls 310B-E, 312B-E depend downwardly along a substantially vertical axis or 90 degree angle parallel to the center axis A or exit axis Y. The two sidewalls 310B-E, 312B-E directly opposing each other are similar or identical in shape, size, and surface area. The distance between the first sidewall 310B-E to the bottom wall 305B-E is non-equivalent to the distance between the second sidewall 312B-E and the bottom wall 305B-E. Also, the distance between the side walls 310B-E, 312B-E is greater than width of the exit orifice 51B-E. Both sidewalls 310B-E, 312B-E terminate within the interior of the dispensing closure 10B-E near a lower portion of the outer skirt 40B-E including the securing structure 42B-E. Both sidewalls 310B-E, at a top end, are integrally formed with the upper deck 30B-E. The first sidewall 310B-E may be integrally formed with the upper deck 30B-E, exit orifice 51B-E, and spout 80B-E. The sidewalls 310B-E, 312B-E have a uniform thickness along its length starting at the top end and extending to the bottom end. The bottom ends of the sidewalls 310B-E, 312B-E defining a flattened or contoured edge. The sidewalls 310B-E, 312B-E lie along a vertical plane similar to the vertically oriented skirt 20B-E and the center axis A or exit axis Y.

Referring to FIGS. 5-7, the flow conduit 200 of the dispensing closure 10A includes the front and back walls 215A, 215B. In one embodiment, the front and back walls 215A, 215B are positioned equally from the center axis or exit axis Y and depend downwardly along a substantially vertical axis or 90 degree angle parallel to the center axis A or exit axis Y. The front and back walls 215A, 215B are attached or integrally formed with the sidewalls 210A, 210B at approximately 90 degree angles. Referring to FIGS. 8-11, in another embodiment, the front and back walls 315B-E, 317B-E of the dispensing closure 10B-E are positioned unequal or non-uniform distances from the center axis or exit axis Y and depend downwardly along a substantially vertical axis or 90 degree angle parallel to the center axis A or exit axis Y.

The front and back walls 215A, 215B, 315B-E, 317B-E oppose each other and are similar or identical in shape, size, and surface area. The front wall and the back walls 215A, 215B, 315B-E, 317B-E may be integrally formed, attached, or connected with the bottom wall 205. In one embodiment, the front and back wall 215A, 215B, at a middle portion, may bend or curve to accommodate the curvature of the bottom wall 205 where the front wall 215A, back wall 215B, and bottom wall 205 are attached. The distance between the front wall 215A, 315B-E and the back wall 215B, 317B-E is similar to or equivalent to the diameter or width of the bottom wall 205, 305B-E. Both the front wall and the back wall 215A, 215B, 315B-E, 317B-E terminate within the interior of the dispensing closure 10A-E near a lower portion of the outer skirt 40A-E and the end portion of at least one sidewalls 210A, 210B, 310B-E, 312B-E. Both the front wall and back walls 215A, 215B, 315B-E, 317B-E, at respective top ends, are integrally formed with the upper deck 30A-E. The front wall and back walls 215A, 215B, 315B-E, 317B-E may be tapered along its length starting at the top end and extending to the bottom end. The bottom ends of the front and back walls 215A, 215B, 315B-E, 317B-E may define a beveled edge. The front and back walls 215A, 215B, 315B-E, 317B-E, partition wall 120B-E, and side walls 210A, 210B, 310B-E, 312B-E, depend from the upper deck 30A-E.

In one embodiment, the bottom profile of the flow conduit 200 may define a double key-hole shape taken along a horizontal cross-section of the flow conduit 200. The double key-hole shape defines a shape having an arctuate, circular, cylindrical, or rectangular shape with two generally rectangular or non-circular shapes having an individual width smaller than the diameter of the circular shape projecting from the bottom of the flow conduit 200. In addition, the bottom wall 205 and the sidewalls 210A, 210B of the flow conduit 200 define an interior volume, between the exit 51A and entrance orifices 220, 222, which has the general shape of a double key-hole when viewed in a cross-section extending perpendicular to the entrance Z1, Z2 and exit axes Y. Looking at the bottom end of the flow conduit 200, the bottom wall 205 defines an arctuate, rectangular, circular or cylindrical shape and the two entrance orifices 220, 222 on either side of the bottom wall 205 define a rectangular or non-circular shape. The double key-hole shape is critical to preventing the direct flow or product into the flow conduit 200 along the exit axis Y and controlling the flow rate of the product. Of course, similar to the dispensing closure 10 above, the bottom profile taken along a horizontal cross-section may define a single key-hole shape as illustrated in FIGS. 10B-E.

The flow conduit 200, 300, upper deck 30A-E, and inner skirt 60A-E may define temporary fluid trapping areas 65A-E. The temporary fluid trapping areas 65A-E are located exterior to the flow conduit 200, 300 and between the upper deck 30A-E and the inner skirt 60A-E. In one embodiment, the temporary fluid trapping areas 65A-E or temporary serum trapping areas are located in at least one upper corner of the dispensing closure 10A-E where the inner skirt 60A-E, upper deck, and flow conduit 200, 300 are attached or integrally formed together. Before the product enters through the entrance orifices 220, 222, 320B-E, the serum or liquid is temporarily trapped inside these temporary fluid trapping areas 65A-E to allow the solid within the product to remix with the serum before entering into the interior of the flow conduit 200, 300.

The flow conduit 200, 300B-E may have a non-uniform volume and width between the entrance orifice 220, 222, 320B-E and the exit orifice 51A-E. The cross-sectional area of the interior volume of the flow conduit 200, 300B-E maybe larger than the cross-sectional area of the entrance orifice 220, 222, 320B-E or the cross-sectional area of the exit orifice 51A-E. The entrance orifice 220, 222, 320B-E expands into an interior volume larger than the interior volume of the exit orifice 51A-E. Also, the width of the flow conduit 200, 300B-E is substantially less than the surface area of the upper deck 30A-E. Further, the distance between the sidewalls 210A, 210B is greater than the width of the cylindrical portion 110 of the flow conduit 200.

The flow path (see arrow S) of the product for the dispensing closure 10A having a double key-hole shaped flow conduit 200 is illustrated in FIG. 7. First, the product enters through the entrance orifices 220, 222 of a smaller width and into the interior of the flow conduit 200 which has a larger width than the entrance orifices 220, 222 but substantially less than the upper deck 30A. Within the larger volume area of the flow conduit 200, the product decelerates by having the product entering through two different entrance orifices 220, 222 and then colliding within the flow conduit 200. By having two entrance orifices 220, 222, more volume of product is allowed to enter from two different directions which meet near the exit axis Y in the interior volume of the flow conduit 200 which causes the flow rate of the product to further decelerate. Next, the product accelerates into a smaller width exit orifice 51A and out of the spout 80A. As a result, the flow of viscous food condiment through the entrance orifices 220, 222 decelerates into the interior volume of the flow conduit 200 to prevent direct spurting through the exit orifice 51A upon dispensing. The food condiment or product being dispensed without spurting through said exit orifice 51A upon filling of the interior volume and the application of additional pressure to said food condiment or product. The flow conduit 200 provides a non-linear or indirect flow path (see arrow S) from an interior of the closure 10A to an exterior of the closure 10A.

The flow path (see arrows Q, R) of the product for the dispensing closure 10B-E having a flow conduit 300B-E with a key-hole flap is illustrated in FIGS. 8-11. First, the product enters through the entrance orifices 320B-E of a smaller width and into the interior of the flow conduit 300B-E which has a larger width than the entrance orifices 320B-E but substantially less than the upper deck 30B-E. Within the larger volume area of the flow conduit 300B-E, the product decelerates. Next, the product enters into the flow conduit 300B-E through a smaller baffling orifice 150B-E which further decelerates the product into the larger volume cylindrical portion. By having an entrance orifice 320B-E and a baffling orifice 150B-E exiting into a larger volume, the flow rate of the product is further decelerated before exiting through the exit orifice 51B-E. In one embodiment, referring to FIGS. 10-11, the product decelerates through another baffling orifice 123D-E. Next, the product accelerates into a smaller width exit orifice 51B-E and out of the spout 80B-E. As a result, the flow of viscous food condiment or product through the entrance orifice 320B-E decelerates into the interior volume of the flow conduit 300B-E to prevent direct spurting through the exit orifice 51B-E upon dispensing. The food condiment or product being dispensed without spurting through the exit orifice 51B-E upon filling of the interior volume and the application of additional pressure to the food condiment or product. The flow conduit 300B-E provides a non-linear or indirect flow path (see arrows Q, R) from an interior of the closure 10B-E to an exterior of the closure 10B-E.

Based on the disclosure above, the present invention provides a one-piece dispensing closure 10A-E. Also, the invention provides a one-piece dispensing closure 10A-E having a "clean-pour" dispensing characteristic. Furthermore, the invention provide a one-piece dispensing closure 10A-E having a sufficient flow restriction or baffling orifices within the flow path to counter product head pressure created when an upright container is quickly inverted and/or shaken to dispense product.

Figure 12:
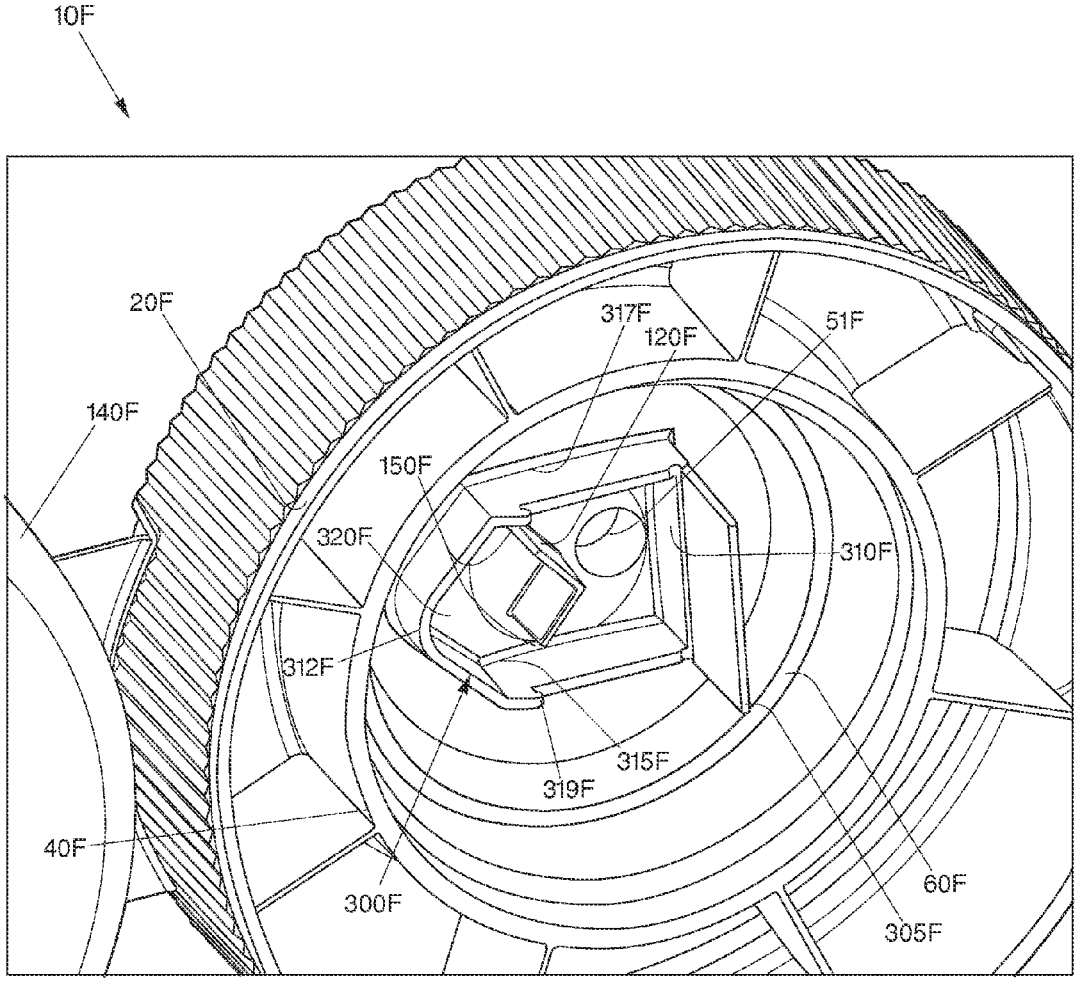
FIG. 12 is a bottom view of another embodiment having a key-hole shaped flow conduit with a v-shaped partition wall and a key-hole flap in an open position.
Figure 13:
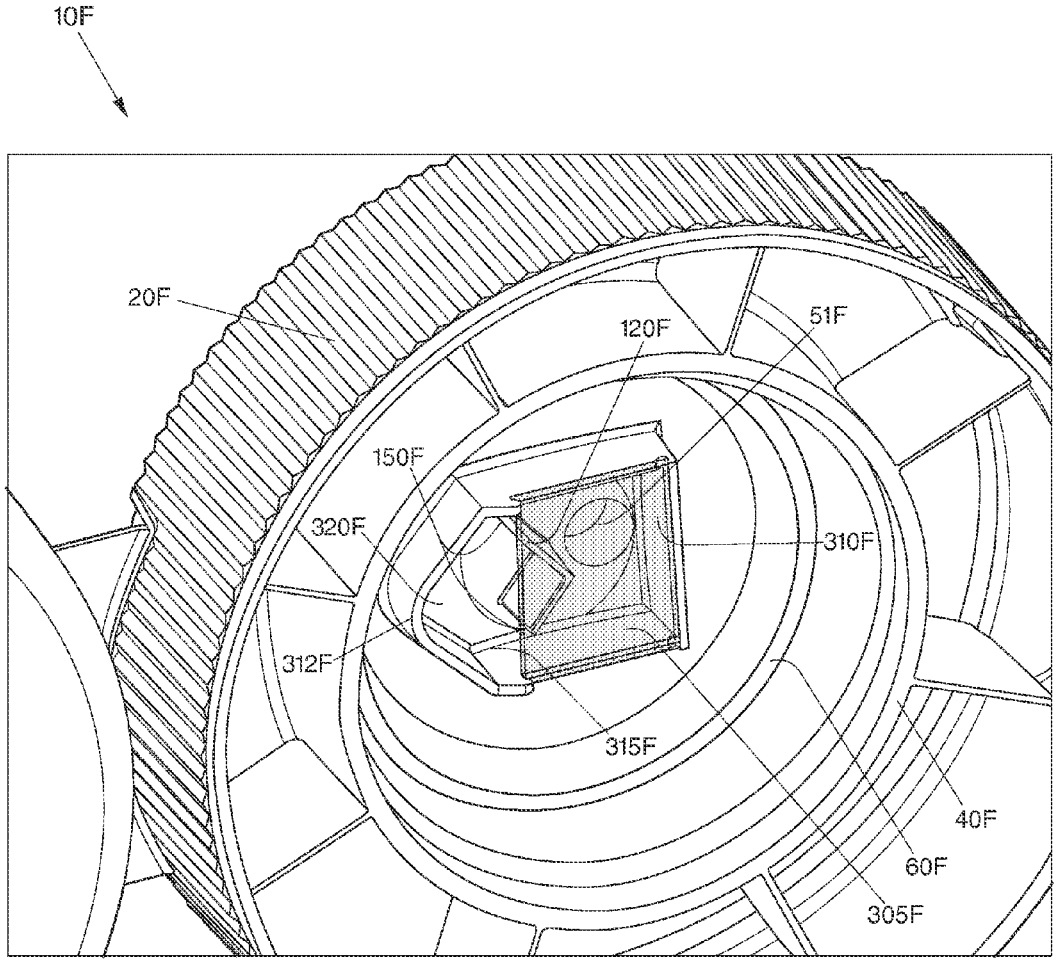
FIG. 13 is a bottom view of FIG. 12 having a key-hole shaped flow conduit with a partition wall and a key-hole flap in a closed position.
Figure 14:
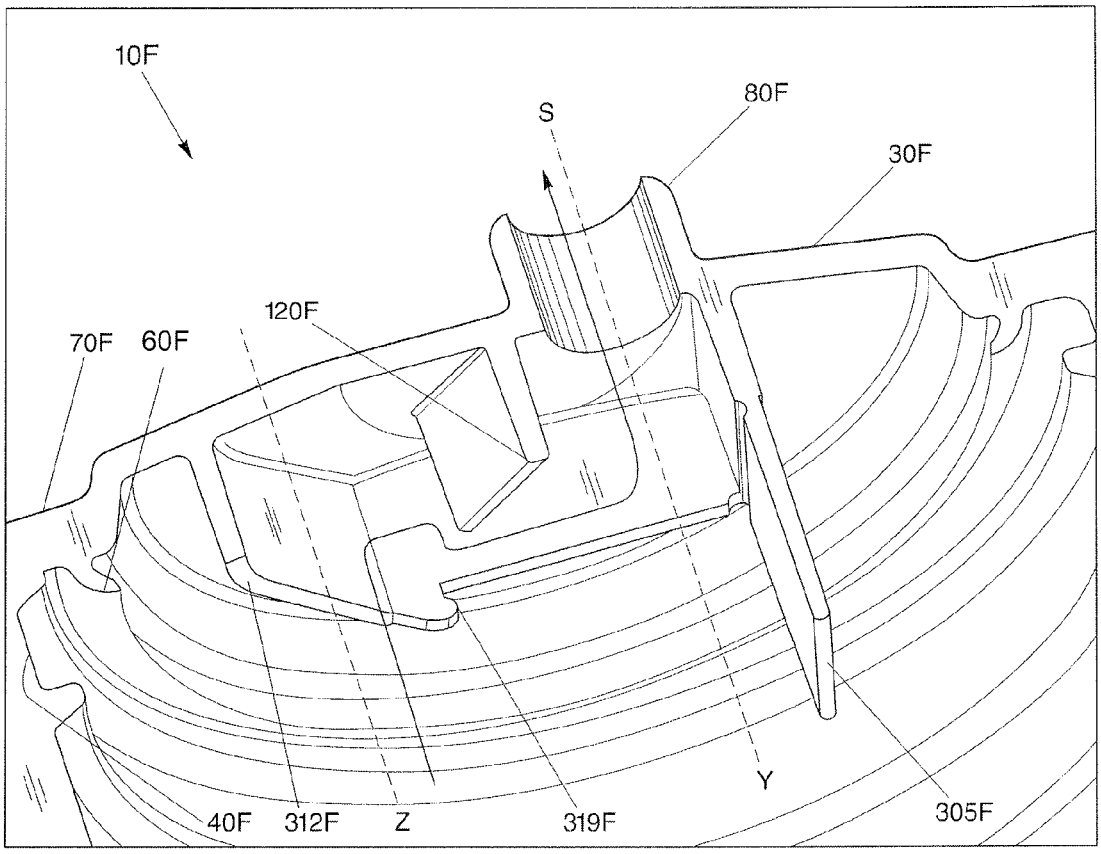
FIG. 14 is cross-sectional view of FIG. 12 having a key-hole shaped flow conduit with a partition wall and key-hole flap in an open position.

Referring to FIGS. 12-14, another embodiment of the dispensing closure 10-10E above incorporates the advantages and benefits of the above-mentioned dispensing closures 10-10E and further includes a dispensing closure 10F having a key-hole shaped flow conduit, key-hole flap as a bottom wall, and a partition wall, which are further explained herein. The dispensing closure has a key-hole shaped flow conduit that provides a sufficient flow restriction to prevent unwanted spurting of the product when the container is initially opened. The dispensing closure 10F is a one-piece element formed of plastic material or other compatible materials for delivery of highly viscous fluids. The closures 10F includes a closure body 20F or closure base, a closure lid 140F, and a dual living hinge structure 140F hingeably connecting said closure lid 130F to said closure body 20F. A dual living hinge structure 140F is an example of one type of hinge structure used and it is contemplated that other types of hinge structures may be used.

The closure body 20F includes an inner 60F and outer skirt 40F defining a longitudinal center axis or exit axis Y of the closure body 20F. The inner skirt 60F located at an upper portion of the closure body 20F and an outer skirt 40F located at a lower portion of the closure body 20F. The outer skirt 40F has a diameter greater than the diameter of the inner skirt 60F. The inner skirt 60F is stepped inwardly of the outer skirt 40F and includes an inner surface facing radially inwardly towards the exit axis Y. A top portion of the inner skirt 60F depends from an upper deck 30F and is integrally formed with the upper deck 30F.

The upper deck 30F extends transversely from a top portion of the inner skirt 60F towards the exit axis Y to define an exit orifice 51F. In one embodiment, the upper deck 30F and the lower deck 70F have a substantially planar surface. The exit orifice 51F is concentric to the surface of the upper deck 30F. It is also contemplated that the exit orifice 51F is eccentric to the surface of the upper deck 30F. The exit orifice 51F defines, in one embodiment, a circular or cylindrical opening in a top end of the closure body 20F for highly viscous fluid to exit therethrough. The exit orifice 51F has an exit axis Y collinear with the center axis of the closure body 20F.

The exit orifice 51F includes a spout 80F which extends above a horizontal plane of the upper deck 30F. The spout 80F defines a cylindrical wall extending vertically above an outer periphery of the exit orifice 51F. In an alternative embodiment, the spout 80F is tapered or may have a non-uniform width along its length. In addition, a top end of the spout 80F may define a beveled edge. In one embodiment, the spout 80F is integrally formed with the exit orifice 51F and the flow conduit 300F.

A lower deck 70F is stepped downwardly from the upper deck 30F and extends transversely from a middle portion of the inner skirt 60F to a top portion of the outer skirt 40F. A lower portion of the inner skirt 60F depends from the upper deck 30F into an interior of the dispensing closure 10F. The inner skirt 60F extends along a substantially vertical axis parallel to the exit axis Y and terminates above a bottom end of the closure 10F.

The outer skirt 40F is configured and arranged to mount to a product container (not shown). The outer skirt 40F includes an internal securing structure 42F for securing the closure 10F to a product container (not shown), which in the preferred embodiment is constructed as at least one helical thread or bead that is defined on the inner surface of the lower portion of the outer skirt 40F. The at least one helical thread is configured to mate with the securing structure, at least one helical thread, of the neck of the product container (not shown). Alternatively, the securing structure 42F could be embodied as an interference fit, a bayonet or snap connection, or one of many other mechanically equivalent techniques that are known in the art.

The outer surface of the outer skirt 40F may define a gripping surface. Referring to FIG. 13, the gripping surface includes a series of vertically spaced ribs 100F covering the outer surface of the outer skirt 40F. Of course, a gripping surface may include knurling or other types of surfaces for facilitating the grip of a user. Alternatively, the outer surface of the outer skirt 40F may be smooth or non-ribbed. In addition, the outer surface of the outer skirt 40F and the closure lid 130F may be provided with a finger indent.

Referring to FIGS. 12-14, in one embodiment, the flow conduit 300F includes a partition wall 120F depending vertically below the upper deck. The partition wall 120F has an inner surface opposing the sidewall 310F. The partition wall 120F maybe adjusted according to the size, shape, dimension, and desired flow rate through the flow conduit 300F. The partition wall 120F depends below the upper deck 30F, proximal to the exit orifice 51F, and above the bottom wall 305F. The partition wall 120F and the bottom wall 305F define a baffling orifice 150F. The partition wall 120F provides a baffling effect to the product as it enters through the baffling orifice 150F and decelerates into the larger volume between the partition wall 120F, sidewall 310F, and bottom wall 305F.

Referring to FIGS. 12-14, the partition wall 120F may have more than one configuration. In one embodiment, the partition wall 120F generally defines a v-shaped or u-shaped partition wall, however, it is contemplated that the v-shaped partition wall or u-shaped partition wall may define other shapes which provide a baffling effect to the product as it enters through the baffling orifice 150F. Referring to FIG. 14, the partition wall 120F depends from the upper deck 30F and proximal to the exit orifice 51F and extends inwardly towards the exit axis Y without connecting or attaching to the opposing side wall 310F. The partition wall 120F may extend downwardly with sufficient height and thickness to define the baffling orifice 150F for decelerating the product before it exits through the exit orifice 51F. The product may become temporarily trapped within an interior surface of the partition wall 120F before it moves around the partition wall 120F on towards to the exit orifice.

Referring to FIGS. 12-14, the bottom wall 305F of dispensing closure 10F, at a first end, is connected, attached, or integrally formed with the sidewall 310F, and front and back walls 315F, 317F of the flow conduit 300F. The bottom wall 305F defines a flap or a key-hole flap, connected or attached to the side wall 310F integrally formed with the upper deck 30F, exit orifice 51F, and spout 80F. During the manufacturing process, the bottom wall 305F is molded vertically or downwardly and then pivoted or folded horizontally or upwardly to prevent the direct flow of product along the exit axis Y and through the exit orifice 51F.

In one embodiment, the bottom wall 305F and the side wall 310F are integrally formed or molded together and are foldable relative to one another using methods known in the art. For example, the bottom wall 305F and the side wall 310F may have a perforated or folding line extending therebetween. In another example, the thickness of the material between the bottom wall 305F and the sidewall 305F may be thinned or reduced to allow the bottom wall 305F to fold upwardly towards the side wall 310F. In another embodiment, the bottom wall 305F may be hingedly or pivotally connected to the side wall 310F using a hinge or other connection structure. Of course, these are examples and other methods of folding or pivoting the bottom wall 305F relative to the side wall 310F are also contemplated.

Referring to FIGS. 12-13, the flow conduit 300F may define a connection area 319F for attaching, connecting, engaging, or latching a second end of the bottom wall 305F. The second end of the bottom wall 305F is configured for securing to the connection area 319F when in a folded or horizontal position. In one embodiment, the connection area 319F defines a latching groove for attachment with the second end of the bottom wall 305F. The second end of the bottom wall 305F frictionally engages the latching groove of the connection area 319F to secure the bottom wall 305F in a closed position and prevent the direct flow of product out of the exit orifice 51F. When in a secured or closed position, the bottom wall 305F engages a bottom end of the flow conduit 300F including the side wall 310F, front wall 317F, and back walls 315F. Other alternative methods known in the art for attaching, latching, connecting, or securing the second end of the bottom wall 305F into the closed position is also contemplated.

In an open position, before folding or pivoting towards the sidewall 310F, the bottom wall 305F allows the direct flow of product out of the exit orifice 51F. In a closed position, after folding or pivoting towards the sidewall 310F, the bottom wall 305F prevents the direct flow of product into the exit orifice 5 51F along the exit axis Y. The bottom wall 305F is configured to pivot or fold from a vertical position along a similar axis to the side wall 310F to a horizontal position along an axis perpendicular to the entrance axis Z.

In one embodiment, one entrance orifice 320F is defined by the bottom wall 305F, sidewalls 310F, 312F, and front and backs walls 315F, 317F. The sidewall 312 F, in one embodiment, defines an arcuate or curved shape. More specifically, the sidewall 312F has a generally defines a u-shape or v-shape with tip portion of the sidewall 312F pointing outwardly towards the inner skirt and away from the exit orifice. The partition wall 120F has a tip portion which points outwardly towards the exit orifice and away from the inner skirt. The entrance orifice 320F is offset or stepped from the exit orifice 51F and exit axis Y. The entrance orifice 320F (inside the container) has an entrance axis Z. The entrance orifice 320F is generally non-circular in shape. The flow rate of the product, once the product enters through the entrance orifice 320F and into the interior of the flow conduit 300F, decelerates. The inner surface area of the sidewall 312F and the inner surface area of the partition wall 120F provides a baffling area for the viscous product to decelerate to prevent spurting of the product before it accelerates around the partition wall 120F and exits through the exit orifice.

Referring to FIGS. 12-14, the first sidewall 310F is positioned closer to the center axis or exit axis Y than the second sidewall 312F. Sidewalls 310F depends downwardly along a substantially vertical axis or 90 degree angle parallel to the center axis A or exit axis Y. The second sidewall 312F depends downwardly from the upper deck and defines a generally curved or arctuate shape. The two sidewalls 310F, 312F directly opposing each other are different in shape, size, and surface area. The distance between the first sidewall 310F to the bottom wall 305F is non-equivalent to the distance between the second sidewall 312F and the bottom wall 305F. Also, the distance between the side walls 310F, 312F is greater than width of the exit orifice 51F. Both sidewalls 310F, 312F terminate within the interior of the dispensing closure 10F near a lower portion of the outer skirt 40F including the securing structure 42F. Both sidewalls 310F, at a top end, are integrally formed with the upper deck 30F. The sidewalls 310F, 312F may have a uniform thickness along its length starting at the top end and extending to the bottom end. The bottom ends of the sidewalls 310F, 312F defining a flattened or contoured edge. The sidewall 310F lies along a vertical plane similar to the vertically oriented skirt 20F and the center axis A or exit axis Y. Referring to FIGS. 12-14, in another embodiment, the front and back walls 315F, 317F of the dispensing closure 10F depend downwardly along a substantially vertical axis or 90 degree angle parallel to the center axis A or exit axis Y.

The front and back walls 315F, 317F oppose each other and are similar or identical in shape, size, and surface area. The front wall and the back walls 315F, 317F may be integrally formed, attached, or connected with the bottom wall 305F. The distance between the front wall 315F and the back wall 317F is similar to or equivalent to the diameter or width of the bottom wall 305F. Both the front wall and the back wall 315F, 317F terminate within the interior of the dispensing closure 10F near a lower portion of the outer skirt 40F and the end portion of at least one sidewalls 310F, 312F. Both the front wall and back walls 315F, 317F at respective top ends, are integrally formed with the upper deck 30F. The front wall and back walls 315F, 317F may define a recess for seating the bottom wall. In addition, the front and back walls 315F, 317F may define latching grooves on a top end of the front and back walls 315F, 317F respectively. The front and back walls 315F, 317F, partition wall 120F, and side walls 310F, 312F, depend from the upper deck 30A-E.

The flow conduit 300F, upper deck 30F, and inner skirt 60F may define temporary fluid trapping areas 65F. The temporary fluid trapping areas 65F are located exterior to the flow conduit 300F and between the upper deck 30F and the inner skirt 60F. In one embodiment, the temporary fluid trapping areas 65F or temporary serum trapping areas are located in at least one upper corner of the dispensing closure 10F where the inner skirt 60F, upper deck, and flow conduit 300F are attached or integrally formed together. Before the product enters through the entrance orifices 320F, the serum or liquid is temporarily trapped inside these temporary fluid trapping areas 65F to allow the solid within the product to remix with the serum before entering into the interior of the flow conduit 300F.

The flow conduit 300F may have a non-uniform volume and width between the entrance orifice 320F and the exit orifice 51F. The cross-sectional area of the interior volume of the flow conduit 300F maybe larger than the cross-sectional area of the entrance orifice 320F or the cross-sectional area of the exit orifice 51F. The entrance orifice 320F expands into an interior volume larger than the interior volume of the exit orifice 51F. Also, the width of the flow conduit 300F is substantially less than the surface area of the upper deck 30F. Further, the distance between the sidewalls 310F, 312F is greater than the width of the cylindrical portion of the flow conduit 200F.

The flow path (see arrow T) of the product for the dispensing closure 10F having a flow conduit 300F with a key-hole flap is illustrated in FIGS. 12-14. First, the product enters through the entrance orifice 320F of a smaller width and into the interior of the flow conduit 300F which has a larger width than the entrance orifice 320F but substantially less than the upper deck 30F. Within the larger volume area of the flow conduit 300F, the product decelerates. Next, the product enters into the flow conduit 300F and contacts the partition wall 120F which restricts the flow of the product.

The partition wall 120F temporarily retains product within the interior surface of the partition wall before it moves around the partition wall between the front and back walls and the partition wall which defines a baffling orifice 150F and into the larger volume area near the exit orifice. The baffling orifice further decelerates the product into the larger volume area near the exit orifice. By having an entrance orifice 320F and a baffling orifice 150F exiting into a larger volume, the flow rate of the product is further decelerated before exiting through the exit orifice 51F. Next, the product accelerates into a smaller width exit orifice 51F and out of the spout 80F. As a result, the flow of viscous food condiment or product through the entrance orifice 320F decelerates into the interior volume of the flow conduit 300F to prevent direct spurting through the exit orifice 51F upon dispensing. The food condiment or product being dispensed without spurting through the exit orifice 51F upon filling of the interior volume and the application of additional pressure to the food condiment or product. The flow conduit 300F provides a non-linear or indirect flow path (see arrow T) from an interior of the closure 10F to an exterior of the closure 10F.

Based on the disclosure above, the present invention provides a one-piece dispensing closure 10F. Also, the invention provides a one-piece dispensing closure 10F having a "clean-pour" dispensing characteristic. Furthermore, the invention provide a one-piece dispensing closure 10F having a sufficient flow restriction or baffling orifices within the flow path to counter product head pressure created when an upright container is quickly inverted and/or shaken to dispense product.

It would be appreciated by those skilled in the art that various changes and modifications can be made to the illustrated embodiments without departing from the spirit of the embodiments. All such modifications and changes are intended to be covered by the appended claims.

What is claimed is:

1. A dispensing closure comprising:

a closure body including a central upper deck and a peripheral lower deck connected by an integrally formed skirt which depends downwardly from said upper deck and merges into said lower deck, an outer skirt depending below and integrally formed with said lower deck, said outer skirt being configured and arranged to mount to a product container, a flow conduit extending through said upper deck, said flow conduit including an exit orifice having an exit axis, said flow conduit including a plurality of sidewalls depending downwardly from said upper deck surrounding said exit orifice and further including a bottom wall depending from said sidewalls, said bottom wall being configured and arranged beneath said exit orifice and generally perpendicular to said exit axis to prevent the direct flow of product into the flow conduit along said exit axis, said upper deck, said plurality of sidewalls and said bottom wall cooperating to define a single entrance orifice having an entrance axis which is parallel to but offset from said exit axis whereby said flow conduit provides a non-linear flow path from the entrance orifice to the exit orifice, said flow conduit further including an interior baffling wall positioned to restrict flow from said entrance orifice to said exit orifice, said baffling wall having a V-shape with an apex oriented in the direction of flow from the entrance orifice to the exit orifice, said baffling wall cooperating with said upper deck, said plurality of sidewalls and said bottom wall to define two spaced baffling orifices downstream from said entrance orifice and to split flow from said entrance orifice into said two baffling orifices.

2. The dispensing closure of claim 1, wherein said baffling wall depends downwardly from said upper deck.

3. The dispensing closure of claim 1, wherein said inner skirt and an outer surface of said sidewalls of said flow conduit cooperate to form a serum capturing well preventing serum from directly entering said entrance orifice.

4. The dispensing closure of claim 2, wherein said upper deck, said inner skirt and an outer surface of said sidewalls of said flow conduit cooperate to form a serum capturing well preventing lower viscosity serum from directly entering said entrance orifice.

* * * * *